US010569562B2

(12) United States Patent
Nakajima et al.

(10) Patent No.: US 10,569,562 B2
(45) Date of Patent: Feb. 25, 2020

(54) LIQUID EJECTING APPARATUS AND CONTROL METHOD OF LIQUID EJECTING APPARATUS

(71) Applicant: SEIKO EPSON CORPORATION, Tokyo (JP)

(72) Inventors: Yoshinori Nakajima, Matsumoto (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/129,675

(22) Filed: Sep. 12, 2018

(65) Prior Publication Data

US 2019/0077165 A1 Mar. 14, 2019

(30) Foreign Application Priority Data

Sep. 13, 2017 (JP) ..... 2017-175720

(51) Int. Cl.
*B41J 2/175* (2006.01)
*B41J 2/18* (2006.01)
*B41J 2/19* (2006.01)

(52) U.S. Cl.
CPC ..... *B41J 2/17596* (2013.01); *B41J 2/175* (2013.01); *B41J 2/17513* (2013.01);
(Continued)

(58) Field of Classification Search
CPC ..... B41J 2/18; B41J 2/19; B41J 2/175; B41J 2/17596; B41J 2/17513; B41J 2/17556; B41J 2/17566
(Continued)

(56) References Cited

U.S. PATENT DOCUMENTS

2008/0273046 A1 11/2008 Ishinaga et al.
2009/0267976 A1 10/2009 Lee et al.
(Continued)

FOREIGN PATENT DOCUMENTS

EP 3175990 A1 6/2017
JP 2006-088564 A 4/2006
(Continued)

OTHER PUBLICATIONS

European Search Report issued in Application No. 18194328 dated Jan. 16, 2019.

*Primary Examiner* — Huan H Tran
*Assistant Examiner* — Alexander D Shenderov
(74) *Attorney, Agent, or Firm* — Workman Nydegger

(57) ABSTRACT

A control method of a liquid ejecting apparatus is provided. The liquid ejecting apparatus includes a liquid ejecting head for ejecting a liquid in an inner-space thereof through a nozzle, an inflow-channel for flowing the liquid into the inner space, an outflow-channel for flowing the liquid out of the inner space, and a valve for the inflow-channel. The control method includes first control of opening the inflow-channel by opening the valve in accordance with a negative pressure on a downstream side of the valve to generate a liquid flow from the inflow-channel to the outflow-channel, second control of opening the inflow-channel by opening the valve by an external force to generate the liquid flow from the inflow-channel to the outflow-channel, and performing the second control, in accordance with a flow amount of the liquid flow, to open the valve under the first control.

20 Claims, 9 Drawing Sheets

(52) U.S. Cl.
CPC ..... *B41J 2/17556* (2013.01); *B41J 2/17566* (2013.01); *B41J 2/18* (2013.01); *B41J 2/19* (2013.01)

(58) Field of Classification Search
USPC ..... 347/85
See application file for complete search history.

(56) References Cited

U.S. PATENT DOCUMENTS

| | | | | |
|---|---|---|---|---|
| 2010/0141722 | A1* | 6/2010 | Saito | B41J 2/17596 347/92 |
| 2010/0231668 | A1 | 9/2010 | Ito | |
| 2010/0231669 | A1* | 9/2010 | Ito | B41J 2/17509 347/92 |
| 2011/0242235 | A1 | 10/2011 | Kitamura | |
| 2015/0321479 | A1 | 11/2015 | Matsumoto et al. | |
| 2017/0217198 | A1 | 8/2017 | Sato et al. | |

FOREIGN PATENT DOCUMENTS

| | | | |
|---|---|---|---|
| JP | 2011-212898 | A | 10/2011 |
| JP | 2014-058166 | A | 4/2014 |

* cited by examiner

LIQUID EJECTING APPARATUS AND CONTROL METHOD OF LIQUID EJECTING APPARATUS

BACKGROUND

1. Technical Field

The present invention relates to technology of ejecting a liquid such as ink.

2. Related Art

Some liquid ejecting apparatuses that eject liquids such as inks through liquid ejecting heads suppress precipitation of components of the liquid by generating a flow of liquid in the liquid ejecting heads. For example, JP-A-2011-212898 discloses a technique of providing a circulating path in a flow channel of a liquid ejecting head and generating a liquid flow in the flow channel of the liquid ejecting head by circulating the liquid through the circulating path. In JP-A-2011-212898, a valve element is provided in the circulating path, and the pressure of the liquid flowing in the circulating path is adjusted by opening the valve element on the basis of a negative pressure on the downstream side of the valve element and the atmospheric pressure.

SUMMARY

However, in the configuration in which a valve element is opened on the basis of a negative pressure on the downstream side of the valve element and the atmospheric pressure as in JP-A-2011-212898, there is a possibility that the opening operation of the valve element becomes unstable because the valve element becomes difficult to move in the case where the amount of liquid flow is small or where the pressure on the downstream side of the valve element is small. In the case where the opening operation of the valve element becomes unstable, the liquid flow generated in the liquid ejecting head also becomes unstable, and the effect of suppressing precipitation of components of liquid is degraded. Considering above, an advantage of some aspects of the invention is to stabilize the opening operation of the valve element at the time of generating a liquid flow in a liquid ejecting head.

Aspect 1

A method according to a preferable embodiment (Aspect 1) of the invention is a control method of a liquid ejecting apparatus. The liquid ejecting apparatus includes a liquid ejecting head that has an inner space through which a liquid flows and that ejects the liquid in the inner space through a nozzle, an inflow channel through which the liquid flows into the inner space, an outflow channel through which the liquid in the inner space flows out, and a valve element (that is, a valve) that opens and closes the inflow channel. The control method includes first control of opening the inflow channel by opening the valve element in accordance with a negative pressure on a downstream side of the valve element to generate a liquid flow from the inflow channel to the outflow channel through the inner space, second control of opening the inflow channel by opening the valve element by an external force to generate the liquid flow from the inflow channel to the outflow channel through the inner space, and performing the second control, in accordance with a flow amount of the liquid flow, to open the valve element that opens by the first control. According to the aspect described above, a liquid flow can be generated in a liquid ejecting head by the first control and the second control. At this time, the valve element moved by the first control is moved by the second control in accordance with the flow amount of the liquid flow, and therefore the valve element can be forcibly opened in the case where the flow amount of the liquid is still small when the valve element is moved by the first control and the opening operation of the valve element becomes unstable. As described above, according to the present aspect, the opening operation of the valve element by the first control can be assisted by the second control in accordance with the flow amount of the liquid. Therefore, the opening operation of the valve element at the time of generating a liquid flow in the liquid ejecting head can be stabilized.

Aspect 2

In a preferable example (Aspect 2) of Aspect 1, the first control includes a first mode in which a pressure in the inflow channel is set to a positive pressure, a second mode in which a pressure in the outflow channel is set to a negative pressure, and a third mode in which the pressure in the inflow channel is set to a positive pressure and the pressure in the outflow channel is set to a negative pressure, and the liquid flow is generated by selectively switching the first mode, the second mode, and the third mode. According to the aspect described above, the flow amount and pressure of the liquid flowing in the flow channel in the liquid ejecting head can be changed by generating a liquid flow by selectively switching the first mode, the second mode, and the third mode. Thus, the most appropriate flow can be selected in accordance with the position at which stagnation of liquid and bubbles have occurred in the flow channel in the liquid ejecting head, and the size of the bubbles can be also changed. Therefore, stagnation of liquid in the liquid ejecting head can be appropriately suppressed, and bubbles can be more easily discharged.

Aspect 3

In a preferable example (Aspect 3) of Aspect 2, the liquid flow is generated in different flow amounts from one another in the first mode, the second mode, and the third mode. According to the aspect described above, since the liquid flow is generated in different flow amounts from one another in the first mode, the second mode, and the third mode, the liquid flow can be generated in such a flow amount as not to break the meniscus in the nozzle.

Aspect 4

In a preferable example (Aspect 4) of any one of Aspects 1 to 3, the second control is performed on the basis of a pressure detected in the outflow channel. According to the aspect described above, the flow amount of the liquid flow can be indirectly detected by detecting a pressure in the outflow channel on the downstream side of the liquid ejecting head. Therefore, by performing the second control on the basis of the pressure detected in the present aspect, the opening operation of the valve element by the second control can be performed appropriately.

Aspect 5

In a preferable example (Aspect 5) of any one of Aspects 1 to 3, the second control is performed on the basis of a flow amount of the liquid detected in the inflow channel or the outflow channel. According to the aspect described above, the flow amount of the liquid flow can be directly detected by detecting a flow amount of the liquid in the inflow channel or the outflow channel. Therefore, by performing the second control on the basis of the flow amount detected in the present aspect, the opening operation of the valve element by the second control can be performed appropriately.

Aspect 6

In a preferable example (Aspect 6) of any one of Aspects 1 to 5, the liquid ejecting apparatus includes a cap that comes into contact with the liquid ejecting head to seal the nozzle, and the liquid flow is generated by the first control and the second control in a state in which the liquid ejecting head and the cap are separated from each other. According to the aspect described above, since the liquid flow is generated by the first control and the second control in a state in which the liquid ejecting head and the cap are separated from each other, the meniscus of the nozzle can be less likely to be broken by a droplet or the like that attaches to the cap at the time of generating the liquid flow as compared with the case where the liquid flow is generated in a state in which the liquid ejecting head and the cap are in contact with each other.

Aspect 7

In a preferable example (Aspect 7) of any one of Aspects 1 to 6, the liquid ejecting apparatus includes a flexible film for moving the valve element, the flexible film has a first surface that constitutes part of the inflow channel downstream of the valve element and a second surface opposite to the first surface, and the valve element is opened by deformation of the flexible film according to pressure difference between a pressure on the first surface and a pressure on the second surface. According to the aspect described above, the liquid flow by the first control can be performed by opening the valve element by deformation of the flexible film according to the pressure difference between the first surface and the second surface.

Aspect 8

According to a preferable example (Aspect 8) of Aspect 7, the external force in the second control is a pressure of a pump that opens the valve element by deforming the flexible film regardless of the pressure difference. According to the aspect described above, the valve element can be opened by driving the pump to deform the flexible film regardless of the pressure difference. In addition, by performing second control by driving the pump in accordance with the flow amount of the liquid flow, the load on the pump can be reduced as compared with a case where the liquid flow is generated by always driving the pump.

Aspect 9

A method according to a preferable aspect (Aspect 9) of the invention is a control method of a liquid ejecting apparatus. The liquid ejecting apparatus includes a liquid ejecting head that has an inner space through which a liquid flows and that ejects the liquid in the inner space through a nozzle, an inflow channel through which the liquid flows into the inner space, an outflow channel through which the liquid in the inner space flows out, and a valve element that opens and closes the inflow channel, and the control method includes generating a liquid flow from the inflow channel to the outflow channel through the inner space by opening, by an external force and to open the inflow channel, the valve element that opens in accordance with a negative pressure on a downstream side of the valve element. According to the aspect described above, since the valve element opened in accordance with the negative pressure on the downstream side of the valve element is opened by the external force to open the inflow channel, the valve element can be forcibly opened in the case where the flow amount of the liquid flow is small and the opening operation of the valve element is unstable. As described above, according to the present aspect, the valve element opened in accordance with the negative pressure on the downstream side of the valve element can be assisted by the opening operation by the external force. Therefore, the opening operation of the valve element at the time of generating a liquid flow in the liquid ejecting head can be stabilized.

Aspect 10

A liquid ejecting apparatus according to a preferable embodiment (Aspect 10) of the invention includes a liquid ejecting head that has an inner space through which a liquid flows and that ejects the liquid in the inner space through a nozzle, an inflow channel through which the liquid flows into the inner space, an outflow channel through which the liquid in the inner space flows out, and a valve element that opens and closes the inflow channel. The liquid ejecting apparatus performs first control of opening the inflow channel by opening the valve element in accordance with a negative pressure on a downstream side of the valve element to generate a liquid flow from the inflow channel to the outflow channel through the inner space and second control of opening the inflow channel by opening the valve element by an external force to generate the liquid flow from the inflow channel to the outflow channel through the inner space. The liquid ejecting apparatus performs the second control, in accordance with a flow amount of the liquid flow, to open the valve element that opens by the first control. According to the aspect described above, a liquid flow can be generated in a liquid ejecting head by the first control and the second control. At this time, the valve element moved by the first control is moved by the second control in accordance with the flow amount of the liquid flow, and therefore the valve element can be forcibly opened by the second control in the case where the flow amount of the liquid is still small when the valve element is moved by the first control and the opening operation of the valve element becomes unstable. As described above, according to the present aspect, the opening operation of the valve element by the first control can be assisted by the second control in accordance with the flow amount of the liquid. Therefore, the opening operation of the valve element at the time of generating a liquid flow in the liquid ejecting head can be stabilized.

Aspect 11

In a preferable example of Aspect 10 (Aspect 11), the first control includes a first mode in which a pressure in the inflow channel upstream of the valve element is set to a positive pressure, a second mode in which a pressure in the outflow channel is set to a negative pressure, and a third mode in which the pressure in the inflow channel upstream of the valve element is set to a positive pressure and the pressure in the outflow channel is set to a negative pressure, and the liquid flow is generated by selectively switching the first mode, the second mode, and the third mode. According to the aspect described above, the flow amount and pressure of the liquid flowing in the flow channel in the liquid ejecting head can be changed by generating a liquid flow by selectively switching the first mode, the second mode, and the third mode. Thus, the most appropriate flow can be selected in accordance with the position at which stagnation of liquid and bubbles have occurred in the flow channel in the liquid ejecting head, and the size of the bubbles can be also changed. Therefore, stagnation of liquid in the liquid ejecting head can be appropriately suppressed, and bubbles can be more easily discharged.

Aspect 12

In a preferable example (Aspect 12) of Aspect 11, the liquid flow is generated in different flow amounts from one another in the first mode, the second mode, and the third mode. According to the aspect described above, since the liquid flow is generated in different flow amounts from one another in the first mode, the second mode, and the third mode, the liquid flow can be generated in such a flow amount as not to break the meniscus in the nozzle.

Aspect 13

In a preferable example (Aspect 13) of any one of Aspects 10 to 12, the second control is performed on the basis of a pressure detected in the outflow channel. According to the aspect described above, the flow amount of the liquid flow can be indirectly detected by detecting a pressure in the outflow channel on the downstream side of the liquid ejecting head. Therefore, by performing the second control on the basis of the pressure detected in the present aspect, the opening operation of the valve element by the second control can be performed appropriately.

Aspect 14

In a preferable example (Aspect 14) of any one of Aspects 10 to 12, the second control is performed on the basis of a flow amount of the liquid detected in the inflow channel or the outflow channel. According to the aspect described above, the flow amount of the liquid flow can be directly detected by detecting a flow amount of the liquid in the inflow channel or the outflow channel. Therefore, by performing the second control on the basis of the flow amount detected in the present aspect, the opening operation of the valve element by the second control can be performed appropriately.

Aspect 15

A preferable example (Aspect 15) of any one of Aspects 10 to 14, includes a cap that comes into contact with the liquid ejecting head to seal the nozzle, and the liquid flow is generated by the first control and the second control in a state in which the liquid ejecting head and the cap are separated from each other. According to the aspect described above, since the liquid flow is generated by the first control and the second control in a state in which the liquid ejecting head and the cap are separated from each other, the meniscus of the nozzle can be less likely to be broken by a droplet or the like that attaches to the cap at the time of generating the liquid flow as compared with the case where the liquid flow is generated in a state in which the liquid ejecting head and the cap are in contact with each other.

Aspect 16

In a preferable example (Aspect 16) of any one of Aspects 10 to 15, the liquid ejecting apparatus includes a flexible film for moving the valve element, the flexible film has a first surface that constitutes part of the inflow channel downstream of the valve element and a second surface opposite to the first surface, and the valve element is opened by deformation of the flexible film according to pressure difference between a pressure on the first surface and a pressure on the second surface. According to the aspect described above, the liquid flow by the first control can be performed by opening the valve element by deformation of the flexible film according to the pressure difference between the first surface and the second surface.

Aspect 17

According to a preferable example (Aspect 17) of Aspect 16, the external force in the second control is a pressure of a pump that opens the valve element by deforming the flexible film regardless of the pressure difference. According to the aspect described above, the valve element can be forcibly opened by deforming the flexible film regardless of the pressure difference by driving the pump. In addition, by performing second control by driving the pump in accordance with the flow amount of the liquid flow, the load on the pump can be reduced as compared with a case where the liquid flow is generated by always driving the pump.

Aspect 18

A liquid ejecting apparatus according to a preferable aspect (Aspect 18) of the invention includes a liquid ejecting head that has an inner space through which a liquid flows and that ejects the liquid in the inner space through a nozzle, an inflow channel through which the liquid flows into the inner space, an outflow channel through which the liquid in the inner space flows out, and a valve element that opens and closes the inflow channel, and the control method includes generating a liquid flow from the inflow channel to the outflow channel through the inner space by opening, by an external force and to open the inflow channel, the valve element that opens in accordance with a negative pressure on a downstream side of the valve element. According to the aspect described above, since the valve element opened in accordance with the negative pressure on the downstream side of the valve element is opened by the external force to open the inflow channel, the valve element can be forcibly opened in the case where the flow amount of the liquid flow is small and the opening operation of the valve element is unstable. As described above, according to the present aspect, the valve element opened in accordance with the negative pressure on the downstream side of the valve element can be assisted by the opening operation by the external force. Therefore, the opening operation of the valve element at the time of generating a liquid flow in the liquid ejecting head can be stabilized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
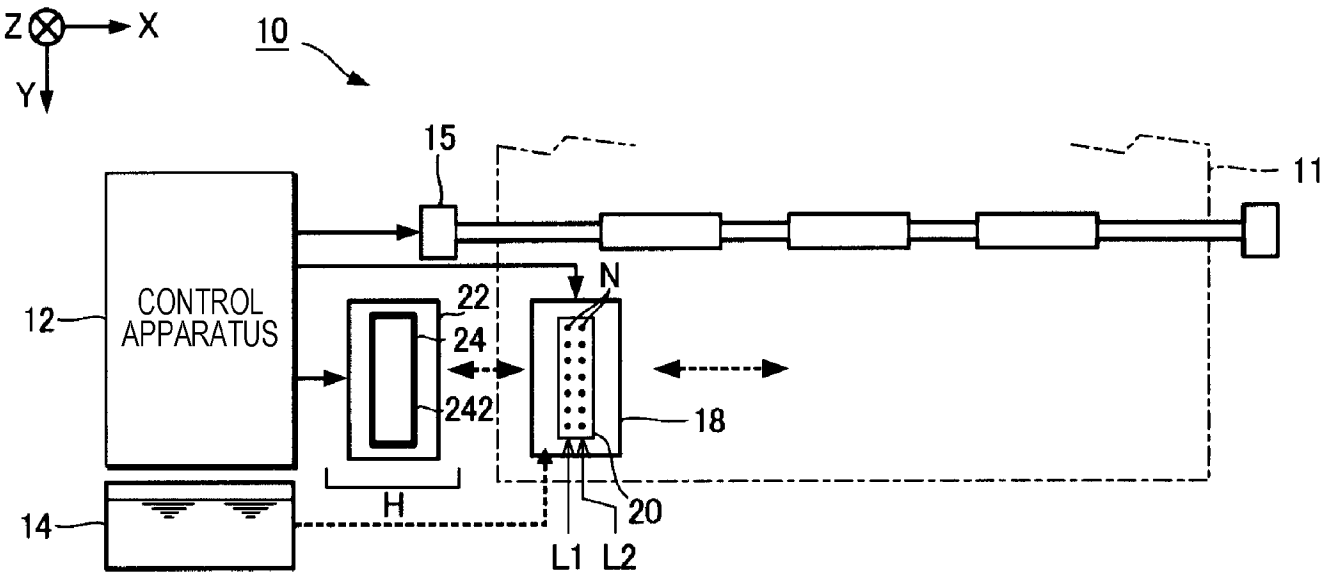
FIG. 1 illustrates a configuration of a liquid ejecting apparatus according to a first embodiment.

FIG. 1 illustrates a partial configuration of a liquid ejecting apparatus 10 according to a first embodiment of the invention. The liquid ejecting apparatus 10 of the first embodiment is a printing apparatus of an ink jet type that ejects an ink, which is an example of a liquid, onto a medium 11 such as a printing sheet. The liquid ejecting apparatus 10 shown in FIG. 1 includes a control apparatus 12, a transport mechanism 15, a carriage 18, a liquid ejecting head 20, and a maintenance unit 22. A liquid container 14 that accommodates an ink is attached to the liquid ejecting apparatus 10.

The liquid container 14 is a cartridge of an ink tank type constituted by a box-shaped container that is attachable to and detachable from a body of the liquid ejecting apparatus 10. To be noted, the liquid container 14 is not limited to a box-shaped container, and may be a cartridge of an ink pack type constituted by a bag-shaped container. The liquid container 14 accommodates an ink. The ink may be a black ink or a color ink. The ink accommodated in the liquid container 14 is pumped to the liquid ejecting head 20.

The control apparatus 12 performs overall control of elements of the liquid ejecting apparatus 10. The transport mechanism 15 transports the medium 11 in a Y direction under the control of the control apparatus 12. The liquid ejecting head 20 ejects the ink supplied from the liquid container 14 onto the medium 11 through a plurality of nozzles N under the control of the control apparatus 12. The plurality of nozzles N are formed on an ejecting surface that is opposed to the medium 11.

The liquid ejecting head 20 is mounted on the carriage 18. Although a case where one liquid ejecting head 20 is mounted on the carriage 18 is illustrated in FIG. 1 as an example, the number of liquid ejecting heads 20 is not limited to this, and a plurality of liquid ejecting heads 20 may be mounted on the carriage 18. The control apparatus 12 causes the carriage 18 to reciprocate in an X direction crossing the Y direction (orthogonal to the Y direction in FIG. 1). A desired image is formed on a surface of the medium 11 by the liquid ejecting head 20 ejecting an ink onto the medium 11 during transport of the medium 11 and reciprocation of the carriage 18. To be noted, the carriage 18 may mount a plurality of liquid ejecting heads 20. A direction perpendicular to an X-Y plane (plane parallel to the surface of the medium 11) is referred to as a Z direction.

The maintenance unit 22 is disposed in, for example, a non-printing region H that serves as a home position (standby position) of the carriage 18 in the X direction. The maintenance unit 22 performs a maintenance process of the liquid ejecting head 20 when the carriage 18 is in the non-printing region H. The maintenance unit 22 includes a capping mechanism 24 controlled by the control apparatus 12.

The capping mechanism 24 is used when capping the ejecting surface of the liquid ejecting head 20. The capping mechanism 24 includes a cap 242 that seals the nozzles N of the ejecting surface. The cap 242 is formed in a box shape opening on the −Z side thereof. The nozzles N of the ejecting surface are sealed as a result of an edge portion of the opening of the cap 242 coming into contact with the ejecting surface. The cap 242 can be moved, by a motor (not illustrated), toward the −Z side on which the cap 242 comes into contact with the ejecting surface or toward the +Z side on which the cap 242 moves away from the ejecting surface. The control apparatus 12 brings the cap 242 into contact with the ejecting surface and thus seals the nozzles N. At this time, a thickening ink and bubbles can be discharged onto the cap 242 by sucking these through the nozzles N by a pump (not illustrated) communicating with the cap 242. The ink discharged onto the cap 242 is discarded, through a flow channel communicating with the cap 242, to a waste liquid tank that is not illustrated.

Examples of the maintenance process of the liquid ejecting head 20 include a cleaning process and a flushing process of the liquid ejecting head 20. The cleaning process is a maintenance process of forcibly discharging an ink from the nozzles N by the pump (not illustrated) communicating with the cap 242. The flushing process is a maintenance process of causing the nozzles N to eject an ink by applying an ejecting waveform to a piezoelectric element. By discharging the thickening ink and bubbles through the nozzles N by performing a maintenance process such as the cleaning process or the flushing process, clogging and ejection failure of the nozzles N can be suppressed.

Figure 2:
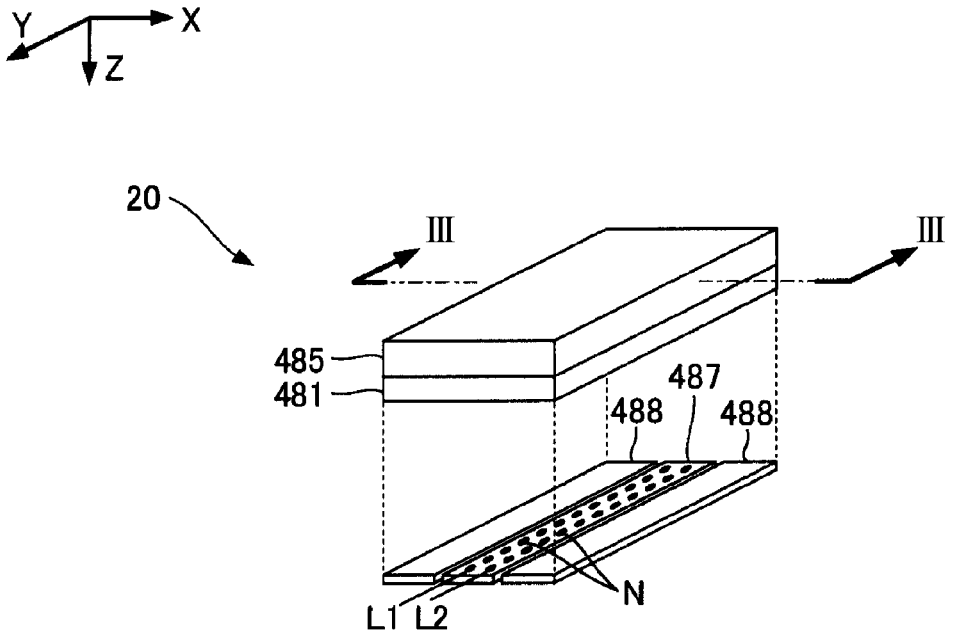
FIG. 2 is an exploded perspective view of a liquid ejecting head.
Figure 3:
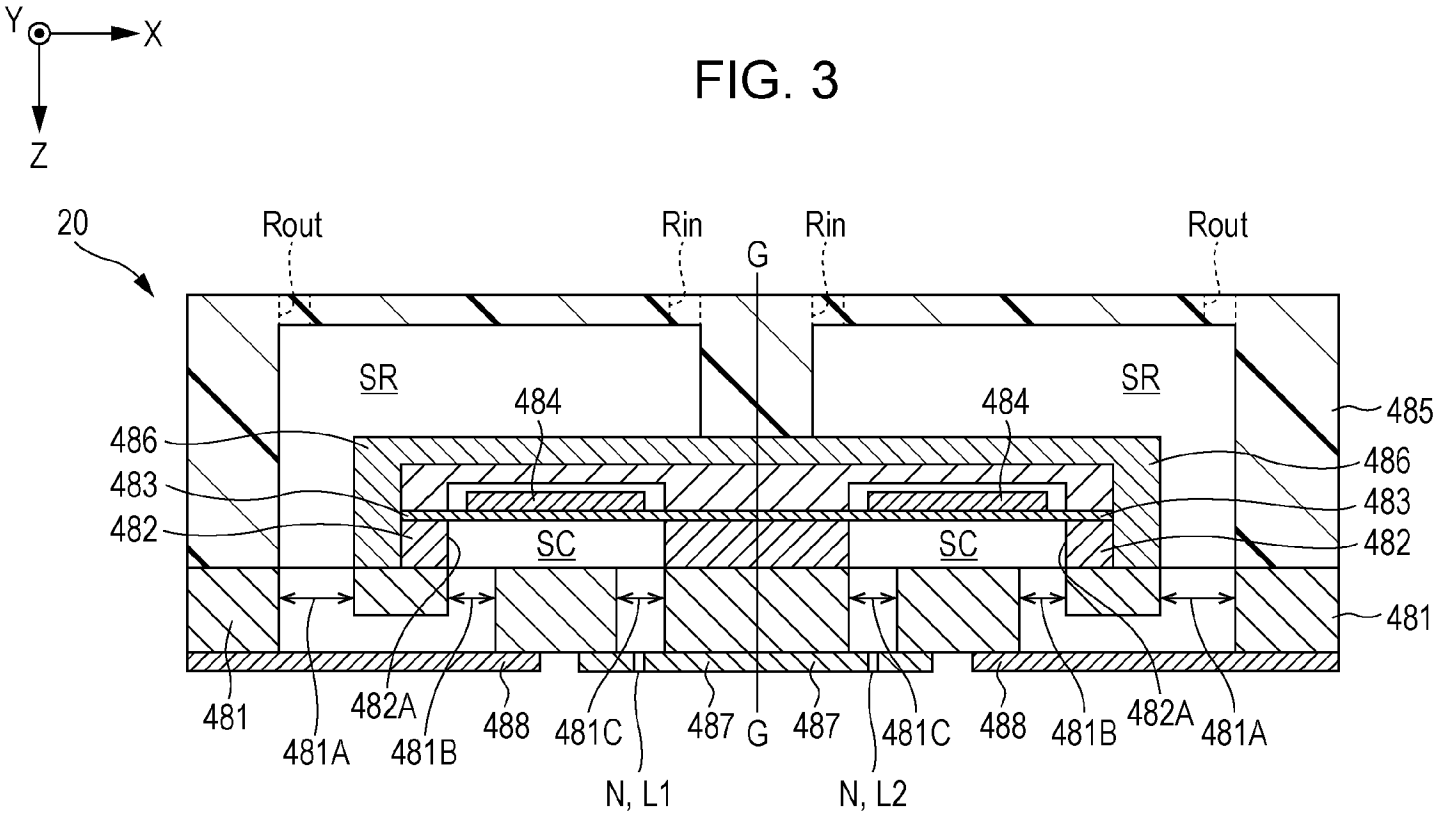
FIG. 3 is a section view of the liquid ejecting head illustrated in FIG. 2 taken along a line III-III.

FIG. 2 is an exploded perspective view of the liquid ejecting head 20. FIG. 3 is a section view of the liquid ejecting head 20 illustrated in FIG. 2 taken along a line III-III. As illustrated in FIGS. 2 and 3, the liquid ejecting head 20 ejects an ink supplied from the liquid container 14 through the plurality of nozzles N. The liquid ejecting head 20 is a structure in which a pressure chamber substrate 482, a diaphragm 483, piezoelectric elements 484, a housing portion 485, and a sealing element 486 are disposed on one side of a channel substrate 481 and a nozzle plate 487 and a buffer plate 488 are disposed on the other side of the channel substrate 481. The channel substrate 481, the pressure chamber substrate 482, and the nozzle plate 487 are each constituted by, for example, a silicon material having a flat plate shape, and the housing portion 485 is formed by, for example, injection molding of a resin material. The plurality of nozzles N are formed in the nozzle plate 487. A surface of the nozzle plate 487 not facing the channel substrate 481 corresponds to the ejecting surface (surface of the liquid ejecting head 20 facing the medium 11).

The plurality of nozzles N can be divided into a first nozzle row L1 and a second nozzle row L2. The first nozzle row L1 and the second nozzle row L2 are each a group of a plurality of nozzles arranged along the Y direction. The first nozzle row L1 and the second nozzle row L2 are arranged parallel with an interval in the X direction therebetween. To be noted, positions of nozzles N of the first nozzle row L1 and nozzles N of the second nozzle row L2 may be varied in the Y direction (so-called staggered arrangement).

As illustrated in FIG. 3, in the liquid ejecting head 20 of the present embodiment, a structure (left part in FIG. 3) corresponding to the first nozzle row L1 and a structure (right part in FIG. 3) corresponding to the second nozzle row L2 are formed in substantially line symmetry with respect to a virtual line G-G extending in the Z direction, and the two structures are substantially the same. Therefore, description below will be given by mainly focusing on the structure corresponding to the first nozzle row L1 (part to the left of the virtual line G-G of FIG. 3).

In the channel substrate 481, an opening portion 481A, branching channels 481B, and communicating channels 481C are defined. Each of the branching channels 481B and the communicating channels 481C is a through hole defined for each nozzle N, and the opening portion 481A is an opening continuous over the plurality of nozzles N. The buffer plate 488 is a flat plate material (compliance substrate) that is disposed on a surface of the channel substrate 481 not facing the pressure chamber substrate 482 and closes the opening portion 481A. Pressure change in the opening portion 481A is absorbed by the buffer plate 488.

In the housing portion 485, a common liquid chamber SR (reservoir) communicating with the opening portion 481A of the channel substrate 481 is formed. The common liquid chamber SR on the left side of FIG. 3 is a space in which the ink to be supplied to the plurality of nozzles N constituting the first nozzle row L1 is to be stored, and is continuous over these nozzles N. The common liquid chamber SR on the right side of FIG. 3 is a space in which the ink to be supplied to the plurality of nozzles N constituting the second nozzle row L2 is to be stored, and is continuous over these nozzles N. In each common liquid chamber SR, an inflow port Rin through which an ink supplied from the upstream side flows in and an outflow port Rout through which the ink flows out toward the downstream side are defined.

In the pressure chamber substrate 482, an opening portion 482A is defined for each nozzle N. The diaphragm 483 is a flat plate material that is disposed on a surface of the pressure chamber substrate 482 not facing the channel substrate 481 and is capable of elastically deforming. A space in each opening portion 482A of the pressure chamber substrate 482 enclosed by the diaphragm 483 and the channel substrate 481 functions as a pressure chamber (cavity) SC in which the ink supplied from the common liquid chamber SR through the branching channel 481B is injected. Each pressure chamber SC communicates with a nozzle N through a communicating channel 481C of the channel substrate 481.

On the surface of the diaphragm 483 not facing the pressure chamber substrate 482, a piezoelectric element 484 is formed for each nozzle N. The piezoelectric elements 484 are each a driving element in which a piezoelectric body is interposed between two opposing electrodes. In the case where the diaphragm 483 vibrates as a result of the piezoelectric elements 484 deforming due to a supplied driving signal, the pressure in the pressure chamber SC changes and the ink in the pressure chamber SC is ejected through a nozzle N. The sealing element 486 protects the plurality of piezoelectric elements 484. To be noted, the piezoelectric elements 484 are connected to the control apparatus 12 via a flexible printed circuit (FPC) or a chip on film (COF) that is not illustrated.

Figure 4:
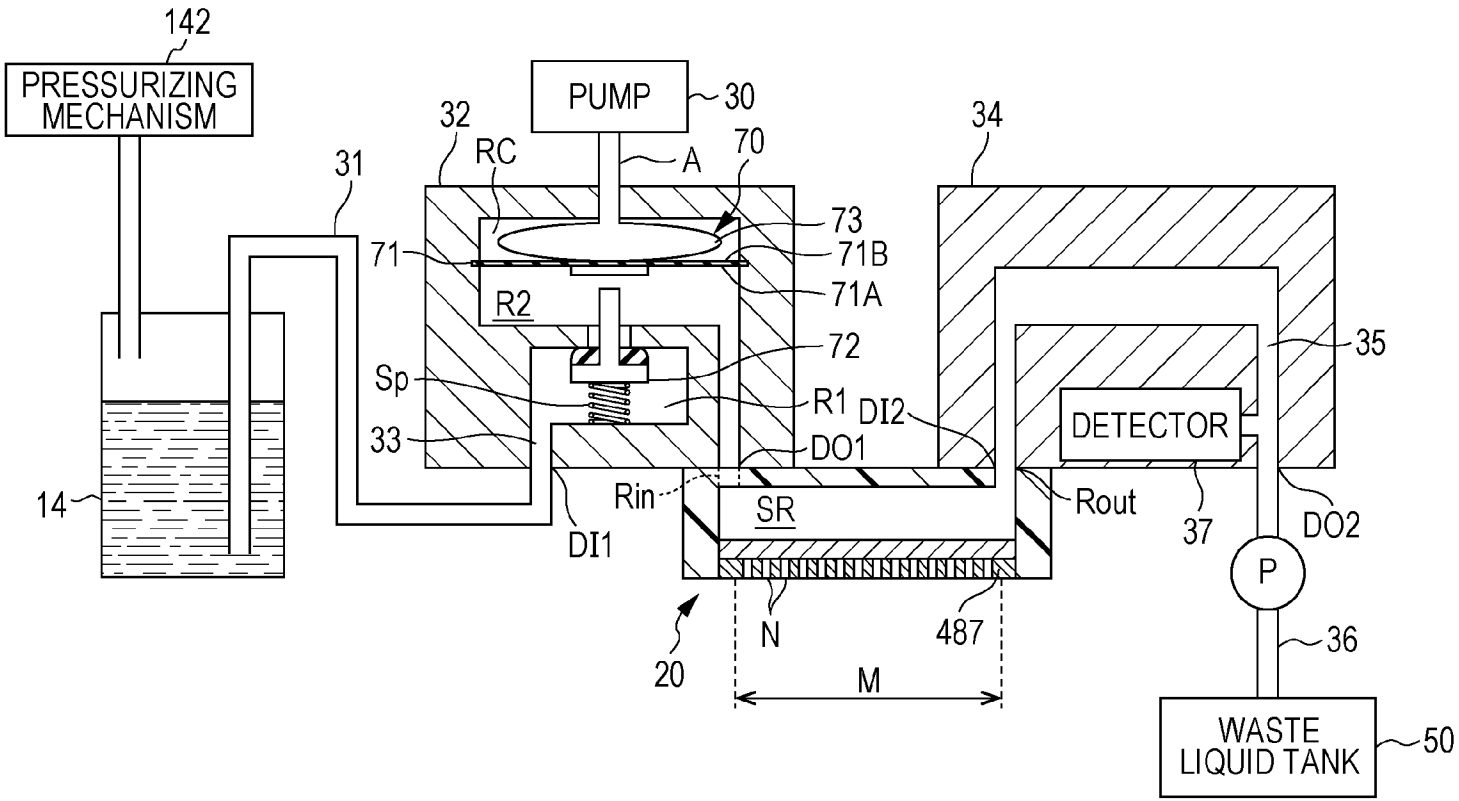
FIG. 4 is a diagram for describing a channel configuration of the liquid ejecting head.

FIG. 4 is a diagram for describing a channel configuration of the liquid ejecting head 20. The liquid ejecting apparatus 10 of the present embodiment can suppress precipitation of components of the ink or the like by generating an ink flow in the liquid ejecting head 20. Such an ink flow may be generated during printing, in a printing standby state, or during cleaning of the liquid ejecting head 20. In addition, the ink flow may be generated intermittently at certain intervals. The common liquid chamber SR of the present embodiment functions as an inner space of the liquid ejecting head 20 in which the ink flows, and a case where an ink flow is generated in the common liquid chamber SR will be described as an example in the present embodiment. FIG. 4 is a simplified section view of the structure corresponding to the first nozzle row L1 of the liquid ejecting head 20 taken along a Y-Z plane. The channel configuration of the structure corresponding to the second nozzle row L2 is similar, so detailed description thereof will be omitted herein.

In the channel configuration of FIG. 4, an upstream channel member 32 is provided upstream of the liquid ejecting head 20, and a downstream channel member 34 is provided downstream of the liquid ejecting head 20. The upstream channel member 32 is a channel structure in which an inflow channel 33 is formed. The inflow channel 33 is a flow channel through which the ink in the liquid container 14 flows into the liquid ejecting head 20. An ink inlet DI1 of the inflow channel 33 is connected to a supply channel 31 communicating with the liquid container 14. An ink outlet DO1 of the inflow channel 33 is connected to the inflow port Rin of the common liquid chamber SR. The liquid container 14 is connected to a pressurizing mechanism 142 for pressurizing and transferring (pumping) the ink in the liquid container 14. The pressurizing mechanism 142 of the present embodiment is constituted by an air pump. The inside of the liquid container 14 is pressurized by air from the air pump, and the ink in the liquid container 14 is pumped into the inflow channel 33 through the supply channel 31. Therefore, the pressure in the inlet DI1 of the inflow channel 33 can be adjusted by the pressurizing mechanism 142. To be noted, the pressurizing mechanism 142 is not limited to the air pump, and may be a liquid transfer pump provided in the supply channel 31 or an elevating mechanism that adjusts the head pressure of the ink in the liquid container 14 by moving up and down the liquid container 14.

The downstream channel member 34 is a channel structure in which an outflow channel 35 is formed. The outflow channel 35 is a flow channel through which the ink in the liquid ejecting head 20 flows out. An ink inlet DI2 of the outflow channel 35 is connected to the outflow port Rout of the common liquid chamber SR. An ink outlet DO2 of the outflow channel 35 is connected to a discharge channel 36 communicating with the waste liquid tank 50. The discharge channel 36 is a flow channel for discharging the ink in the common liquid chamber SR to the waste liquid tank 50. A liquid transfer pump P is provided in the discharge channel 36. The liquid transfer pump P functions as a pump for generating an ink flow, and is constituted by a depressurizing pump. Therefore, by adjusting the pressure in the outlet DO2 of the outflow channel 35 by the liquid transfer pump P, the amount of ink flow (flow amount of the ink flow generated in the liquid ejecting head 20) can be adjusted.

In the outflow channel 35, a detector 37 for detecting the flow amount or pressure of the ink flowing in the outflow channel 35 is provided. In the case of detecting the flow amount of ink flowing in the outflow channel 35, the detector 37 is constituted by a flowmeter, and in the case of detecting the pressure in the outflow channel 35, the detector 37 is constituted by a manometer. As described above, the flow amount of ink in the outflow channel 35 may be directly detected by constituting the detector 37 by a flowmeter, or may be indirectly detected from the pressure in the outflow channel 35 by constituting the detector 37 by a manometer. In the case of indirectly measuring the flow amount of ink by a manometer, for example, the relationship between the pressure and flow amount in the outflow channel 35 is measured in advance, and the flow amount of ink is obtained from the pressure detected by the manometer on the basis of the relationship between the pressure and flow amount. To be noted, in the case of detecting the flow amount of ink by the detector 37, the detector 37 may be provided in the inflow channel 33 or the supply channel 31.

A valve device 70 (self-sealing valve) is provided in the upstream channel member 32. The valve device 70 of the present embodiment is opened by a pressure difference between the pressure on the downstream side and the atmospheric pressure, and can be also forcibly opened (forced opening operation) by an external force. The valve device 70 includes an upstream channel R1 and a downstream channel R2 constituting part of the inflow channel 33. The upstream channel R1 is connected to the supply channel 31. A valve element 72 is disposed between the upstream channel R1 and the downstream channel R2. The downstream channel R2 is adjacent to an atmospheric pressure chamber RC communicating with the air. A flexible film 71 is interposed between the downstream channel R2 and the atmospheric pressure chamber RC, and the flexible film 71 partition the downstream channel R2 from the atmospheric pressure chamber RC. The flexible film 71 is an elastic film having flexibility, and is constituted by, for example, plastic, rubber, and fiber.

The valve element 72 opens and closes the inflow channel 33. Specifically, the valve element 72 lets the upstream channel R1 and the downstream channel R2 communicate with each other (open state) or blocks the upstream channel R1 and the downstream channel R2 from each other (closed state). The valve element 72 is provided with a spring Sp that urges the valve element 72 toward the direction in which the upstream channel R1 and the downstream channel R2 are blocked from each other. Therefore, when no force is applied to the valve element 72, the upstream channel R1 and the downstream channel R2 are blocked from each other. However, in the case where a force is applied to the valve element 72 against the urging force of the spring Sp and the valve element 72 is moved toward the +Z side, the upstream channel R1 and the downstream channel R2 communicate with each other.

A bag-shaped body 73 is disposed in the atmospheric pressure chamber RC. The bag-shaped body 73 is a bag-shaped member formed from an elastic material such as rubber. The bag-shaped body 73 is connected to a pump 30 via a gas channel A. The pump 30 of the present embodiment is a pump capable of pressurizing and depressurizing the gas channel A, and is typically constituted by an air pressure pump. The pump 30 may be constituted by a single pump that can be used for both of pressurization and depressurization, or may be constituted by two separate pumps respectively used for pressurization and depressurization. The pump 30 is driven in accordance with a sequence selected from a plurality of sequences in accordance with an instruction from the control apparatus 12. The plurality of sequences include a pressurizing sequence of supplying air to the gas channel A and a depressurizing sequence of sucking air from the gas channel A. The bag-shaped body 73 swells when the gas channel A is pressurized (by supplying air) in the pressurizing sequence, and the bag-shaped body 73 contracts when the gas channel A is depressurized (by sucking air) in the depressurizing sequence.

In the state in which the bag-shaped body 73 is contracted, in the case where the pressure in the downstream channel R2 is maintained in a predetermined range, the valve element 72 is urged by the spring Sp to be pressed upward (toward the −Z side), and thus the upstream channel R1 and the downstream channel R2 are blocked from each other. In contrast, in the case where the pressure in the downstream channel R2 is decreased to reach a predetermined negative pressure due to ejection and suction of ink by the liquid ejecting head 20, the valve element 72 is opened. The opening operation of the valve element 72 corresponds to the valve element 72 moving downward (toward the +Z side) against the urging force of the spring Sp so as to let the upstream channel R1 and the downstream channel R2 communicate with each other. That is, in the case where the surface of the flexible film 71 constituting part of the downstream channel R2 is referred to as a first surface 71A and the surface on the atmospheric pressure chamber RC side opposite to the first surface 71A is referred to as a second surface 71B, the valve element 72 moves when the flexible film 71 is deformed in accordance with a pressure difference between the pressure (negative pressure) on the first surface 71A and the pressure (atmospheric pressure) on the second surface 71B. The valve element 72 is opened when the pressure in the downstream channel R2 reaches a predetermined negative pressure with respect to the atmospheric pressure, the upstream channel R1 and the downstream channel R2 communicate with each other and thus the inflow channel 33 opens. To be noted, although a case where the valve element 72 is configured to open and close in accordance with the pressure difference between the pressure on the first surface 71A and the pressure on the second surface 71B of the flexible film 71 has been described as an example in the present embodiment, the valve element 72 may be configured to open and close in accordance with the pressure difference between the pressure in the upstream channel R1 and the pressure in the downstream channel R2.

In addition, by causing the bag-shaped body 73 to swell by the pressurization by the pump 30, the flexible film 71 can be deformed by an external force from the bag-shaped body 73 regardless of the negative pressure (pressure difference) in the downstream channel R2 to forcibly open the valve element 72. That is, the opening operation of the valve element 72 by the external force described herein corresponds to opening the inflow channel 33 by forcibly opening the valve element 72 (forced opening operation) by the external force regardless of the negative pressure (pressure difference) in the downstream channel R2. To be noted, the valve element 72 may be forcibly opened by deforming the flexible film 71 by using a pressing force from a pressurizing rubber or a pressing force from a cam as the external force instead of the pressure from the pump 30.

According to such a channel configuration of the present embodiment, by driving the liquid transfer pump P, the downstream side of the valve element 72 is depressurized and the valve element 72 is opened to open the inflow channel 33, and thus an ink flow in which the ink in the liquid container 14 flows from the inflow channel 33 to the outflow channel 35 through the common liquid chamber SR can be generated. Specifically, when the liquid transfer pump P is driven, the pressure in the outlet DO2 of the outflow channel 35 decreases to be a negative pressure, and thus the pressure in the downstream channel R2 communicating with the outflow channel 35 through the common liquid chamber SR also becomes a negative pressure. The flexible film 71 deforms due to the pressure difference between this negative pressure and the atmospheric pressure, and the valve element 72 opens when the pressure reaches the predetermined negative pressure. As a result of this, the valve element 72 opens to open the inflow channel 33, and the ink in the liquid container 14 flows from the inflow channel 33 to the outflow channel 35 through the common liquid chamber SR, and is discharged to the waste liquid tank 50 through the discharge channel 36.

As described above, by generating an ink flow in the common liquid chamber SR in the liquid ejecting head 20, precipitation of components of ink in the common liquid chamber SR can be suppressed, bubbles stagnating in the common liquid chamber SR can be discharged, and stagnation of the bubbles can be suppressed by eliminating stagnation of the ink. Although the common liquid chamber SR has been shown as an example of an inner space in the liquid ejecting head 20 in which an ink flow is generated in the present embodiment, the inner space is not limited to this, and an ink flow may be generated in each pressure chamber SC as the inner space.

To be noted, although a case where the ink to flow in the liquid ejecting head 20 is discharged to the waste liquid tank 50 has been described as an example in the present embodiment, the ink may be discharged to and stored in a replacing ink tank instead of the waste liquid tank 50. The replacing ink tank filled with the ink can replace an ink tank constituting the liquid container 14 to reuse the ink. In addition, in the case where the liquid container 14 is constituted by an ink pack, the pressurizing mechanism 142 is constituted by a pump that adjusts the pressure to be applied to the ink pack.

In the configuration of the present embodiment, in the case where just opening the valve element 72 on the basis of a negative pressure on the downstream side of the valve element 72 does not realize an enough flow amount of ink or enough pressure on the downstream side of the valve element 72, there is a possibility that the opening operation of the valve element 72 becomes unstable because the valve element 72 becomes difficult to move. In the case where the opening operation of the valve element 72 becomes unstable, the ink flow generated in the liquid ejecting head 20 also becomes unstable, and the effect of suppressing precipitation of components of liquid is degraded.

Therefore, in the present embodiment, the valve element 72 to be opened in accordance with the negative pressure on the downstream side of the valve element 72 is forcibly opened by an external force to open the inflow channel 33, and thus an ink flow from the inflow channel 33 to the outflow channel 35 through the common liquid chamber RS is generated. According to this, an ink flow can be generated by forcibly opening the valve element 72 by forcibly deforming the flexible film 71 by the external force from the pump 30 in the case where the flow amount of ink is small and the opening operation of the valve element 72 becomes unstable. As a result of this, the opening operation of the valve element 72 can be assisted in accordance with the flow amount of ink. Therefore, the opening operation of the valve element 72 at the time of generating an ink flow in the liquid ejecting head 20 can be stabilized. In addition, by performing second control by driving the pump 30 in accordance with the flow amount of ink, the load on the pump 30 can be reduced as compared with a case where the flow is generated by always driving the pump 30.

Figure 5:
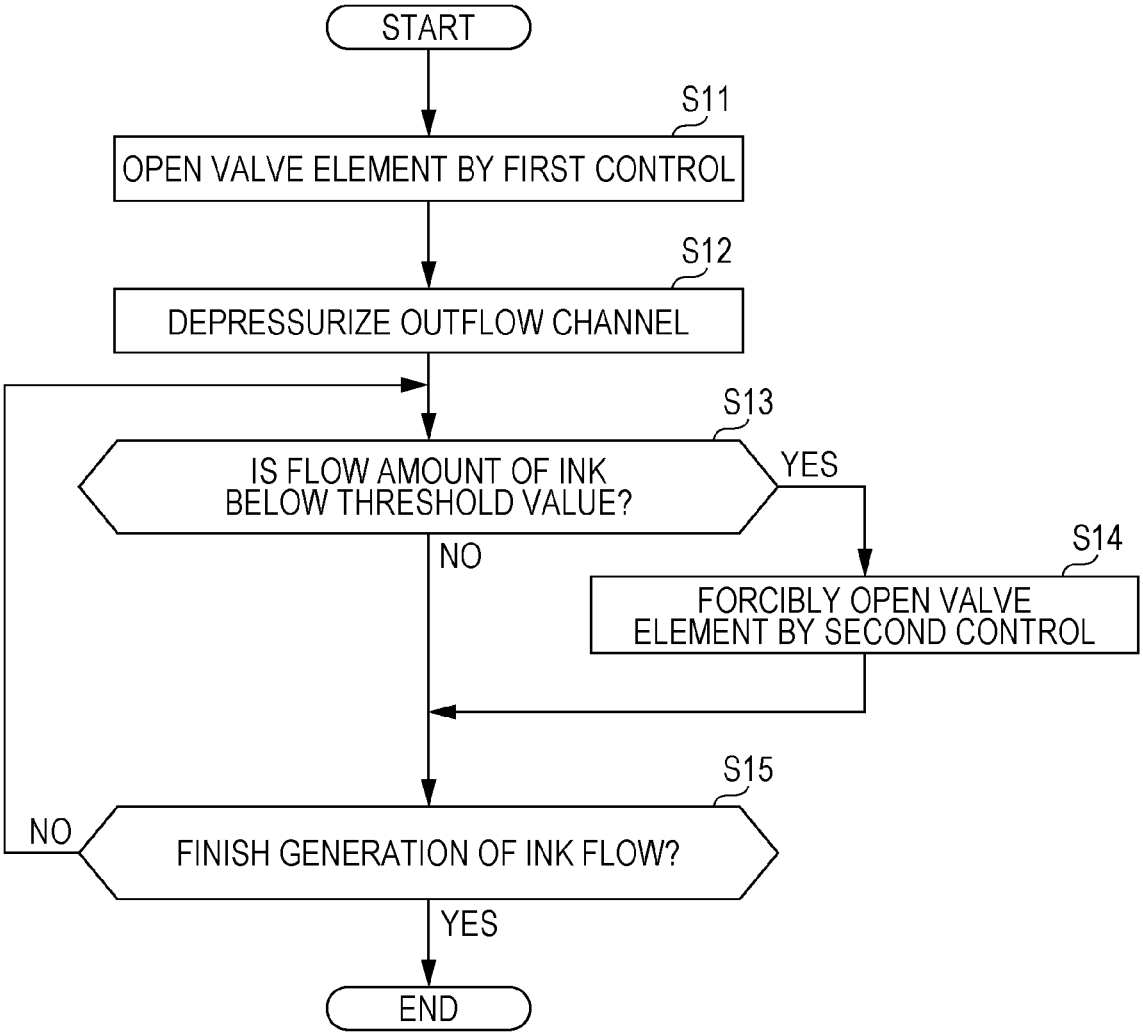
FIG. 5 is a flowchart illustrating a control method of the liquid ejecting apparatus.
Figure 6:
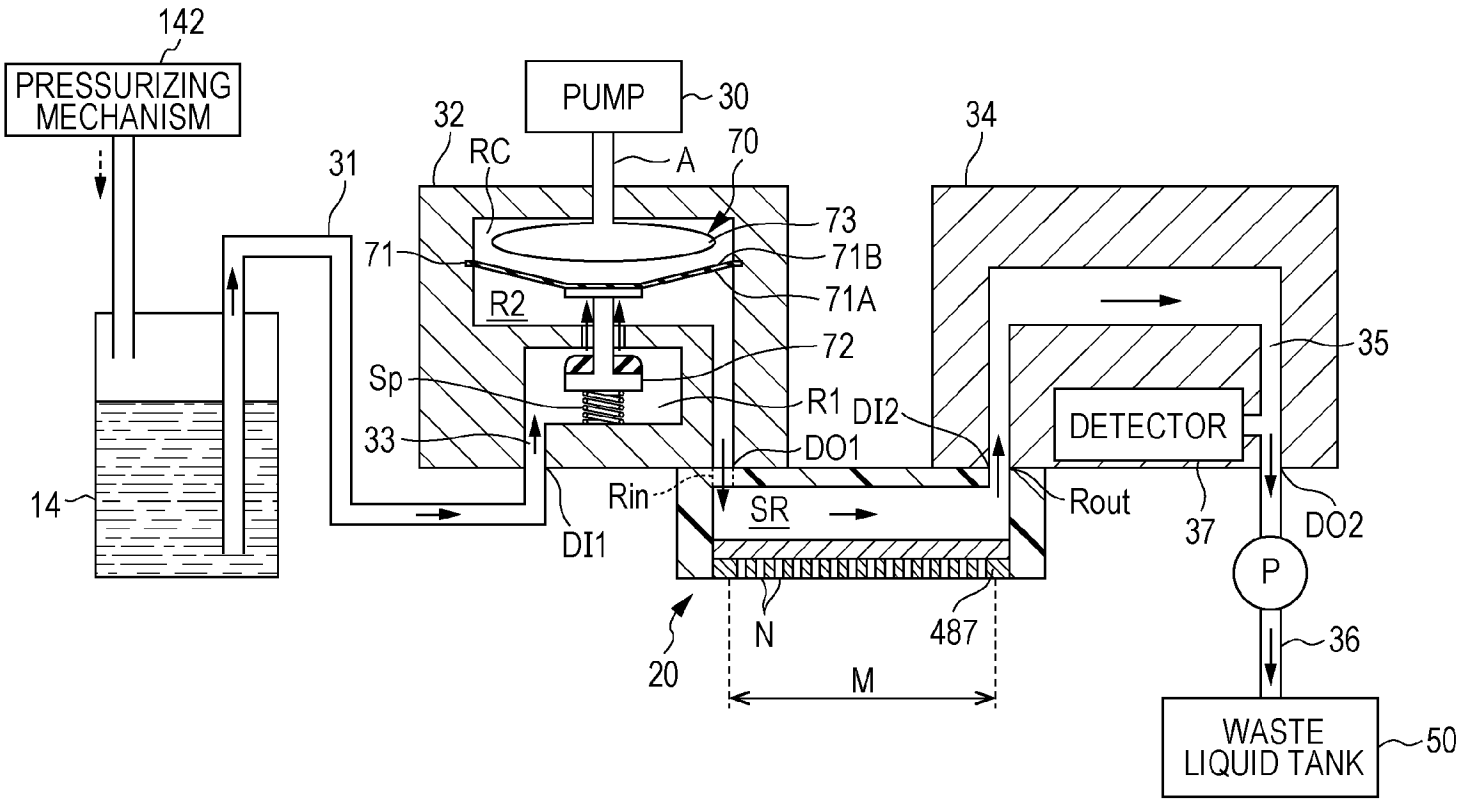
FIG. 6 is a diagram for describing an opening operation of a valve element in first control.
Figure 7:
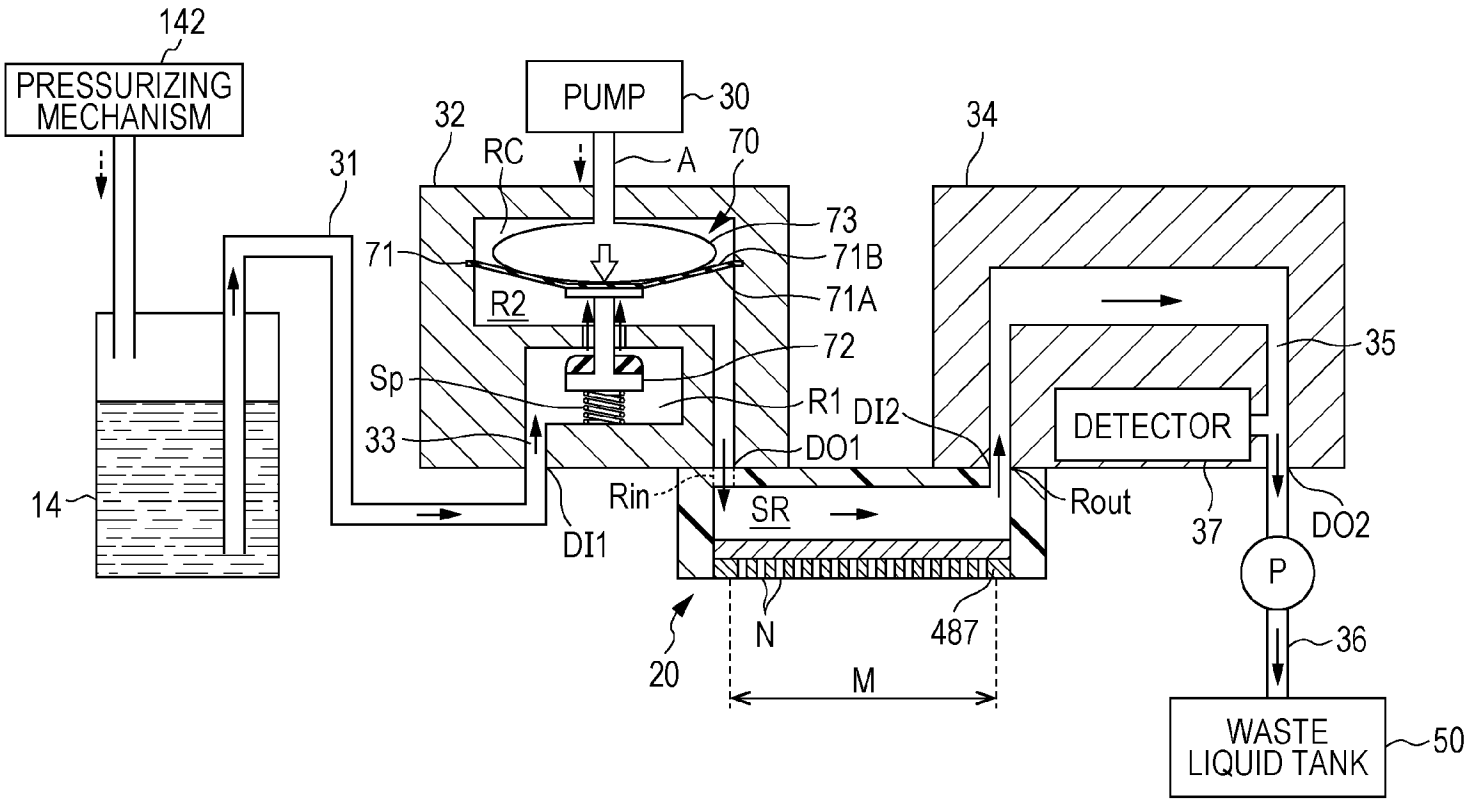
FIG. 7 is a diagram for describing a forced opening operation of the valve element in second control.

Next a control method of the liquid ejecting apparatus 10 for generating such an ink flow will be described. FIG. 5 is a flowchart illustrating a control method of the liquid ejecting apparatus 10 for generating an ink flow in the present embodiment. In FIG. 5, control of generating an ink flow from the inflow channel 33 to the outflow channel 35 through the common liquid chamber SR by opening the inflow channel 33 by the opening operation of the valve element 72 in accordance with the negative pressure on the downstream side of the valve element 72 is referred to as first control. In addition, control of generating the ink flow from the inflow channel 33 to the outflow channel 35 through the common liquid chamber SR by opening the inflow channel 33 by a forced opening operation of the valve element 72 by an external force from the pump 30 is referred to as second control. FIG. 6 is a diagram for describing the opening operation of the valve element 72 in the first control, and FIG. 7 is a diagram for describing the forced opening operation of the valve element 72 in the second control.

As illustrated in FIG. 5, first, the control apparatus 12 opens the valve element 72 by first control in step S11, depressurizes the outflow channel 35 in step S12, and thus generates an ink flow in the common liquid chamber SR. Specifically, by making the pressure (pressure in the downstream channel R2) in the outlet DO2 of the outflow channel 35 a negative pressure by driving the liquid transfer pump P, the valve element 72 is opened to open the inflow channel 33 by deformation of the flexible film 71 due to the pressure difference between the negative pressure and the atmospheric pressure. As a result of this, the valve element 72 opens as illustrated in FIG. 6, and the ink flow from the inflow channel 33 to the outflow channel 35 through the common liquid chamber SR is generated.

Next, in step S13, the control apparatus 12 determines whether or not the flow amount of ink is below a threshold value. Specifically, the control apparatus 12 determines whether or not the flow amount of ink in the outflow channel 35 detected by the detector 37 is below a predetermined threshold value. The predetermined threshold value is such a flow amount of ink that the opening operation of the valve element 72 becomes unstable when the flow amount of ink becomes below the threshold value. Specifically, for example, the predetermined threshold value is a flow amount equal to or smaller than approximately 30% to 50% of a flow amount of full ejection (ejection duty is 100%). Here, ejection duty is a ratio of amount of ink ejection with respect to the maximum possible amount of ink ejection per unit time. The flow amount below which the opening operation of the valve element 72 becomes unstable varies depending on the type and individual difference of the apparatus and the type of ink. Therefore, the flow amount below which the opening operation of the valve element 72 becomes unstable may be measured by generating the ink flow while changing the flow amount, and the threshold value may be determined on the basis of results of the measurement.

In the case where the control apparatus 12 has determined that the flow amount of ink is below the predetermined threshold value in step S13 (YES), the control apparatus 12 forcibly opens the valve element 72 by the second control in step S14, and thus generates an ink flow in the common liquid chamber SR. Specifically, as illustrated in FIG. 7, the valve element 72 is forcibly opened to open the inflow channel 33 by driving the pump 30 to expand the bag-shaped body 73 to deform the flexible film 71. As described above, in the case where the flow amount of ink is below the predetermined threshold value, that is, where the opening operation of the valve element 72 becomes unstable under the first control, the inflow channel 33 is opened by forcibly opening the valve element 72 by the second control, and thus the opening operation of the valve element 72 by the first control can be assisted by the second control. Therefore, the opening operation of the valve element 72 at the time of generating an ink flow in the common liquid chamber SR can be stabilized.

In contrast, in the case where the control apparatus 12 has determined that the flow amount of ink is not below the predetermined threshold value in step S13 (NO), the control apparatus 12 determines whether or not to finish generation of the ink flow in step S15. In the case where the control apparatus 12 has determined not to finish the generation of ink flow in step S15 (NO), the process returns to step S13. By returning to step S13, the control apparatus 12 monitors the flow amount of ink while continuing the opening operation of the valve element 72 by the first control until the generation of ink flow is finished. In the case where the control apparatus 12 has determined to finish the generation of ink flow in step S15 (YES), the control apparatus 12 stops the liquid transfer pump P and finishes the control of generating an ink flow.

In addition, the control apparatus 12 also determines whether or not to finish the generation of ink flow in step S15 after forcibly opening the valve element 72 by the second control in step S14. In this case, in the case where the control apparatus 12 has determined not to finish the generation of ink flow in step S15, the process returns to step S13. By returning to step S13, the control apparatus 12 monitors the flow amount of ink while continuing the forced opening operation of the valve element 72 by the second control until the generation of ink flow is finished. In the case where the control apparatus 12 has determined to finish the generation of ink flow in step S15, the control apparatus 12 stops the liquid transfer pump P and finishes the control of generating an ink flow.

As described above, according to the control of the present embodiment, the flow amount of ink can be directly detected by detecting the flow amount of ink in the outflow channel 35 by the detector 37. Therefore, by performing the second control on the basis of the flow amount detected by the detector 37, the forced opening operation of the valve element 72 by the second control can be performed appropriately. To be noted, the detector 37 may be provided in the inflow channel 33 and the forced opening operation of the valve element 72 by the second control may be performed in accordance with the detected flow amount of ink. In addition, in the case of detecting the pressure of ink by the detector 37, the forced opening operation of the valve element 72 by the second control may be performed in accordance with the detected pressure of ink. By detecting the pressure in the outflow channel 35, the flow amount of ink can be indirectly detected. Therefore, by performing the second control on the basis of the detected pressure, the forced opening operation of the valve element 72 by the second control can be performed appropriately.

In addition, according to the control of the present embodiment, in the case where the flow amount of ink is small and the valve element 72 is likely to be unstable with the opening operation of the valve element 72 according to the negative pressure on the downstream side performed by the first control, an ink flow is generated by opening the inflow channel 33 by forcibly opening the valve element 72 by an external force by the second control. As a result of this, the opening operation of the valve element 72 can be stabilized. In addition, the valve element 72 does not have to be opened by increasing the flow amount in the case where the flow amount of ink is small. Therefore, also in the case where the ink that has generated the ink flow is discarded to the waste liquid tank 50 as in the channel configuration of FIG. 4, the amount of ink to be discarded can be greatly reduced as compared with the case where the valve element 72 is opened by increasing the flow amount of ink.

To be noted, at the time of maintenance of the liquid ejecting head 20, the ink flow is generated by the first control and the second control before the liquid ejecting head 20 is sealed by the cap 242, that is, in a state in which the liquid ejecting head 20 and the cap 242 are separated from each other. According to this, the meniscus of the nozzles N is less likely to be broken by a droplet or the like that attaches to the cap 242 at the time of generating an ink flow as compared with the case where the ink flow is generated in a state in which the liquid ejecting head 20 and the cap 242 are in contact with each other. Therefore, an operation of restoring the meniscus of the nozzles N does not have to be performed after sealing the liquid ejecting head 20 with the cap 242.

In addition, in the case of opening the valve element 72 by the first control, the pressure and flow speed of the ink flowing in channels in the liquid ejecting head 20 can be changed by the pressure in the inflow channel 33 (pressure in the inlet DI1) and the pressure in the outflow channel 35 (pressure in the outlet DO2). The pressure in the inflow channel 33 can be adjusted by the pressurizing mechanism 142, and the pressure in the outflow channel 35 can be adjusted by the liquid transfer pump P.

Figure 8:
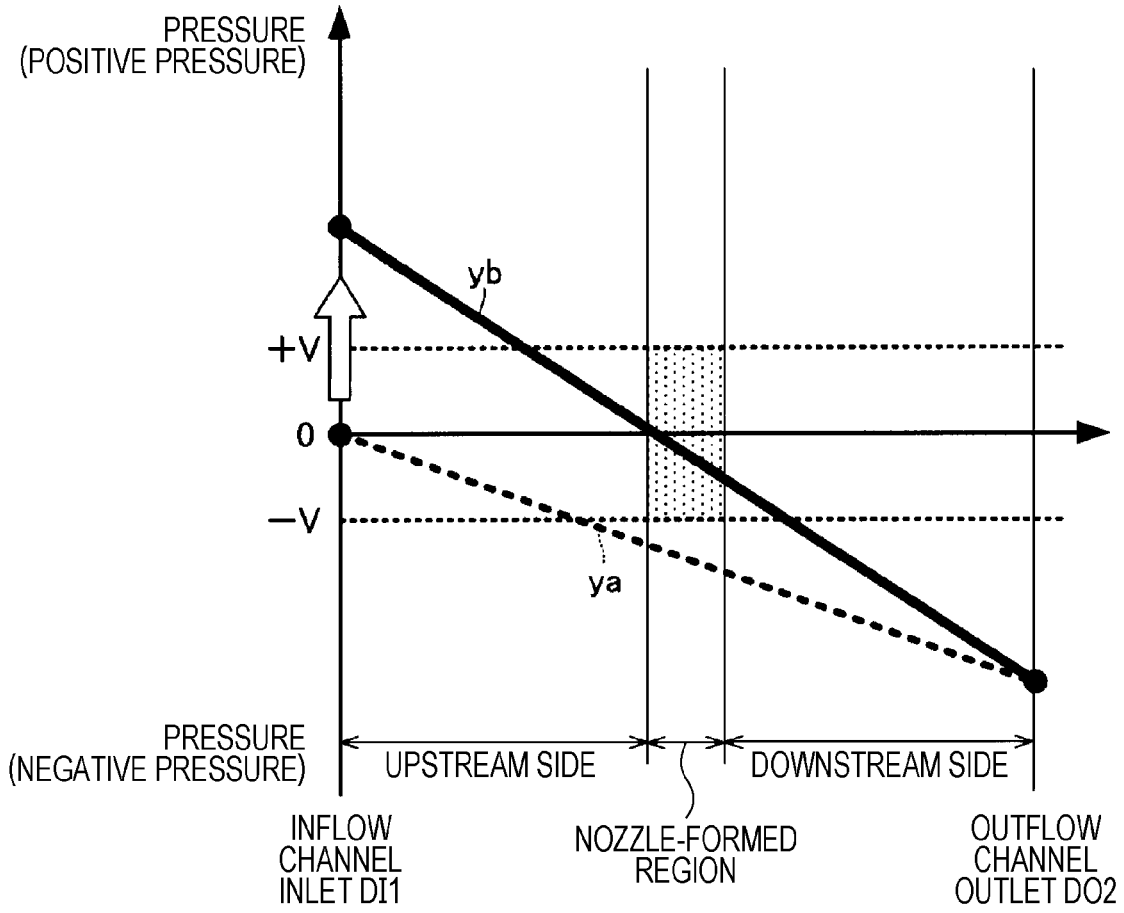
FIG. 8 is a graph showing change in pressure in a flow channel in which an ink flow is generated.

FIG. 8 is a graph in which the relationship between the position and pressure of a channel in which an ink flow is generated is approximated by a straight line, and exemplifies a case where the pressure in the inlet DI1 of the inflow channel 33 is adjusted. The vertical axis of FIG. 8 represents pressure, and above the pressure "0" corresponds to a positive pressure and below the pressure "0" corresponds to a negative pressure. The horizontal axis represents the position in which the ink flow is generated, and indicates a flow channel from the inlet DI1 of the inflow channel 33 on the upstream side to the outlet DO2 of the outflow channel 35 on the downstream side through the liquid ejecting head 20. A "nozzle-formed region" in FIG. 8 corresponds to a region M in which the plurality of nozzles N illustrated in FIG. 4 are formed, and is substantially the same as the region of the common liquid chamber SR. In FIG. 8, the "nozzle-formed region" is placed at the center, and the graph can be roughly divided into the upstream side and the downstream side of the "nozzle-formed region". FIG. 8 is a graph illustrating change in pressure in the channel in which the ink flow is generated, and the pressure at each position in the channel in which the ink flow is generated is approximated by a straight line therein. A graph ya in FIG. 8 is a graph before the pressure in the inlet DI1 of the inflow channel 33 is adjusted, and a graph yb is a graph after the pressure in the inlet DI1 of the inflow channel 33 is adjusted. The greater the inclination of the graph of FIG. 8 is, the greater the flow amount of ink is, and the smaller the inclination of the graph of FIG. 8 is, the smaller the flow amount of ink is. Therefore, the inclination of the graph of FIG. 8 corresponds to the flow amount of ink.

As shown by the graph yb in FIG. 8, in the case where the pressure in the inlet DI1 of the inflow channel 33 is adjusted to a positive pressure, the inclination becomes greater than the graph ya corresponding to before adjusting the pressure, and therefore it can be seen that the flow amount of ink can be increased by setting the pressure in the inlet DI1 of the inflow channel 33 to a positive pressure. In addition, since the pressure on the upstream side increases, the pressure at a position more upstream (upstream side in the common liquid chamber SR) in the plurality of nozzles N becomes greater. At a position with higher pressure, bubbles become smaller and thus becomes less likely to be caught in the channel and more likely to be discharged, and stagnation of ink can be suppressed.

As described above, the inclination of the graph can be changed by the pressure in the inflow channel 33 (pressure in the inlet DI1) and the pressure in the outflow channel 35 (pressure in the outlet DO2). Therefore, the most appropriate flow can be selected in accordance with the position at which stagnation of ink and bubbles have occurred in the channel in the liquid ejecting head 20, and the size of the bubbles can be also changed. Therefore, stagnation of ink in the liquid ejecting head 20 can be appropriately suppressed, and bubbles can be more easily discharged.

In addition, in FIG. 8, an upper limit and a lower limit of a meniscus holding pressure (pressure in which the meniscus is not broken) of the nozzles N are respectively indicated by +V (positive pressure side) and −V (negative pressure side). Therefore, the meniscus is not broken while the pressure of the "nozzle-formed region" is within the range from −V to +V in the graph of FIG. 8, and the meniscus is broken when the pressure becomes below −V. For example, in the graph ya of FIG. 8, the pressure of the "nozzle-formed region" is below the meniscus holding pressure (−V), and thus the meniscus is broken with the ink flow represented by the graph ya. In contrast, the inclination of the graph yb is greater than that of the graph ya, and thus the pressure of the "nozzle-formed region" is not below the meniscus holding pressure (−V). Therefore, by adjusting the pressure in the inlet DI1 of the inflow channel 33 to a positive pressure as indicated by the graph yb, the ink flow can be generated without breaking the meniscus.

On the basis of the above, in the first control of the present embodiment, a first mode, a second mode, and a third mode can be selected. The first mode is a mode in which the pressure in the inflow channel 33 (pressure in the inlet DI1) is set to a positive pressure. The second mode is a mode in which the pressure in the outflow channel 35 (pressure in the outlet DO2) is set to a negative pressure. The third mode is a mode in which the pressure in the inflow channel 33 (pressure in the inlet DI1) is set to a positive pressure and the pressure in the outflow channel 35 (pressure in the outlet DO2) is set to a negative pressure.

According to the first mode, since the pressure in the inflow channel 33 is set to a positive pressure, for example, as illustrated in FIG. 8, bubbles become smaller and thus becomes less likely to be caught in the channel and more likely to be discharged. According to the second mode, since the pressure in the outflow channel 35 is set to a negative pressure, bubbles become bigger and thus becomes more likely to flow and more likely to be discharged. According to the third mode, since the pressure in the inflow channel 33 is set to a positive pressure and the pressure in the outflow channel 35 is set to a negative pressure, the inclination of the graph of FIG. 8 becomes greater, that is, the flow amount of ink can be increased, and thus the ink is more likely to flow from the upstream side to the downstream side. According to such a configuration in which the first mode, the second mode, and the third mode can be selected, stagnation of the ink in the liquid ejecting head 20 can be appropriately suppressed, and bubbles become more likely to be discharged.

In addition, the first mode, the second mode, and the third mode may be configured such that the ink flow is generated in different flow amounts therein. According to this, the ink flow can be generated in such a flow amount that the graph of FIG. 8 has an inclination in which the pressure of the "nozzle-formed region" is not below the meniscus holding pressure (−V). For example, in the third mode, since the pressure in the inflow channel 33 is set to a positive pressure and the pressure in the outflow channel 35 is set to a negative pressure, the graph of FIG. 8 is likely to have such an inclination that the pressure of the "nozzle-formed region" is not below the meniscus holding pressure (−V) even in the case where the flow amount is increased. Therefore, the flow amount of ink can be increased without breaking the meniscus in the nozzles N. Setting the pressure in the inflow channel 33 to a positive pressure as in the first mode increases the flow amount of ink more greatly without breaking the meniscus in the nozzles N than setting the pressure in the outflow channel 35 to a negative pressure as in the second mode.

Second Embodiment

A second embodiment of the invention will be described. Same reference signs used in the description of the first embodiment will be used for elements in the embodiment described below having the same effects and functions as in the first embodiment, and detailed description thereof will be omitted as appropriate. A case where the ink that generates a flow in the liquid ejecting head 20 is discharged to the waste liquid tank 50 has been described as an example in the first embodiment. In the second embodiment, a case where the ink that generates a flow in the liquid ejecting head 20 is returned to the liquid container 14 to circulate will be described as an example.

Figure 9:
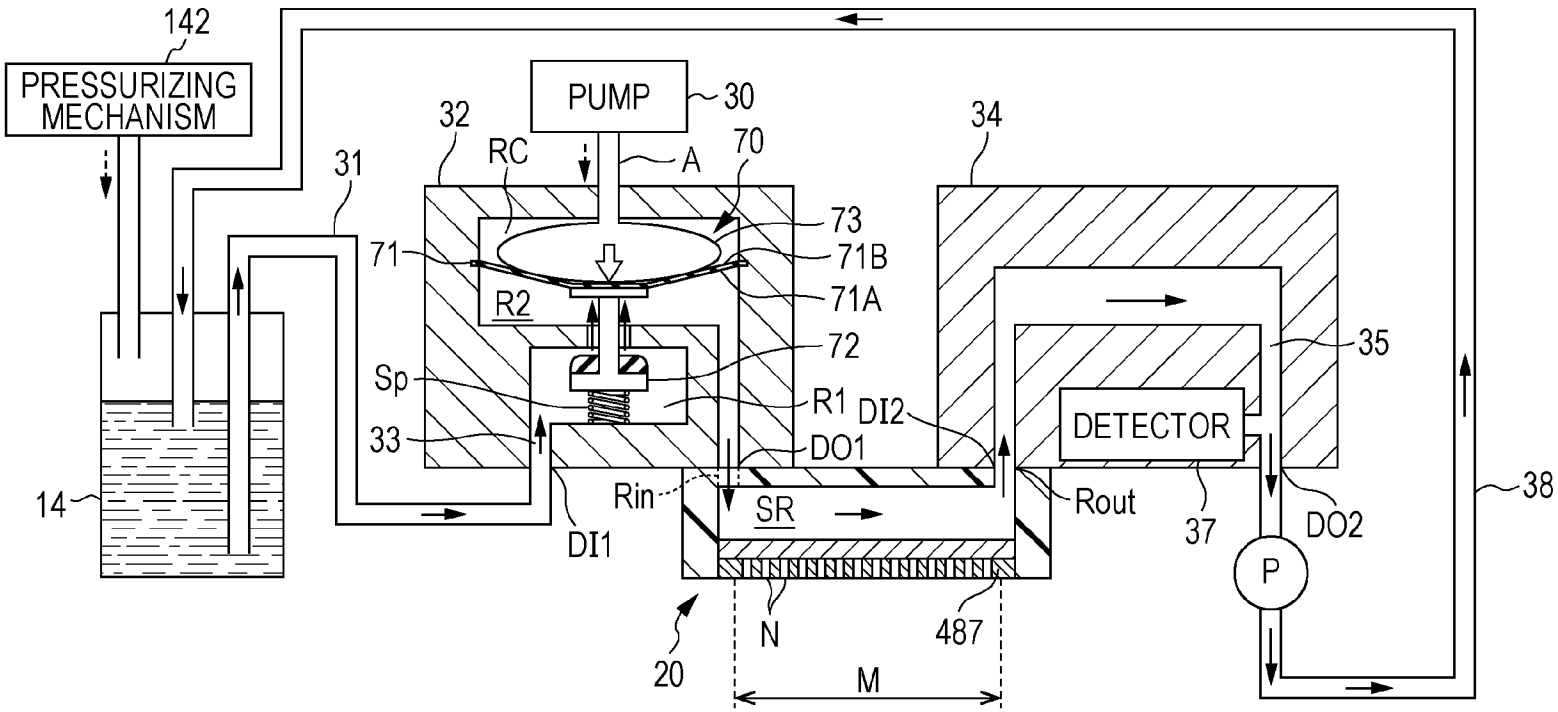
FIG. 9 is a diagram for describing a channel configuration of a liquid ejecting head according to a second embodiment.

FIG. 9 is a diagram for describing a channel configuration of a liquid ejecting head 20 according to the second embodiment. In the channel configuration of FIG. 9, a circulation channel 38 is connected to the outlet DO2 of the outflow channel 35. The circulation channel 38 is a flow channel for returning the ink discharged from the outlet DO2 of the outflow channel 35 to the liquid container 14. The liquid transfer pump P of FIG. 9 is provided in the circulation channel 38. To be noted, the liquid transfer pump P of the present embodiment is a mechanical pump of a constant flow amount such as a tube pump or a gear pump, and has a pressure resistance high enough to avoid flowing back of the ink caused by the pressure (air pressure) of the pressurizing mechanism 142.

According to the channel configuration of FIG. 9, the valve element 72 can be opened to open the inflow channel 33 by driving the liquid transfer pump P by the first control similarly to the channel configuration of FIG. 4. In addition, the valve element 72 can be forcibly opened to open the inflow channel 33 by driving the pump 30 by the second control. In the configuration of FIG. 9, when the inflow channel 33 is opened, the ink in the liquid container 14 flows from the inflow channel 33 to the outflow channel 35 through the common liquid chamber SR, and returns to the liquid container 14 through the circulation channel 38.

As described above, also according to the channel configuration of FIG. 9, the valve element 72 to be opened in accordance with the negative pressure on the downstream side of the valve element 72 can be forcibly opened by an external force to open the inflow channel 33, and thus an ink flow from the inflow channel 33 to the outflow channel 35 through the common liquid chamber RS can be generated. According to this, the valve element 72 opened by the first control can be forcibly opened by the second control in the case where the operation of the valve element 72 is unstable due to, for example, insufficient flow amount of ink. Therefore, the operation of the valve element 72 at the time of generating an ink flow in the liquid ejecting head 20 can be also stabilized according to the channel configuration of FIG. 9. In addition, according to the channel configuration of FIG. 9, since the ink that generates a flow in the liquid ejecting head 20 is returned to the liquid container 14 to circulate, the ink that generates a flow does not have to be discarded, and thus wasteful consumption of ink can be reduced.

A case where the pressure in the outflow channel 35 is set to a negative pressure and the pressure in the inflow channel 33 (pressure on the upstream side of the valve element 72) is set to a positive pressure has been described as an example in the embodiments described above. However, the configuration is not limited to this, and both of the pressure in the outflow channel 35 and the pressure in the inflow channel 33 (pressure on the upstream side of the valve element 72) may be negative pressures or positive pressures.

Modification

The embodiments described above can be modified in various ways. Specific modifications will be described below as examples. Two or more embodiments arbitrarily selected from the examples below and the embodiments above can be appropriately combined as long as the combination is not contradictory.

(1) Although a serial head in which the carriage 18 mounting the liquid ejecting head 20 is reciprocated in the X direction has been described as an example in the embodiments described above, the invention can be also applied to a line head in which the liquid ejecting head 20 is disposed over the whole width of the medium 11.

(2) Although the liquid ejecting head 20 of a piezoelectric system using a piezoelectric element that imparts mechanical vibration to a pressure chamber has been described as an example in the embodiments described above, a liquid ejecting head of a thermal system using a heat generating element that generates bubbles in the pressure chamber by heat can be also employed.

(3) The liquid ejecting apparatus 10 described as an example in the embodiments described above can be employed for various devices such as a facsimile machine and a copier in addition to a device exclusively used for printing. Of course, the use of the liquid ejecting apparatus 10 of the invention is not limited to printing. For example, a liquid ejecting apparatus that ejects a liquid of a color material can be used as a production apparatus that produces a color filter for a liquid crystal display apparatus, an organic electroluminescence (EL) display, a field emission display (FED), or the like. In addition, a liquid ejecting apparatus that ejects a solution of a conductive material can be used as a production apparatus that forms wiring and electrodes in a wired board. In addition, the liquid ejecting apparatus can be also used as a chip production apparatus that ejects a solution of bio-organic substance as a kind of liquid.

CROSS REFERENCE TO RELATED APPLICATIONS

This application claims priority to Japanese Patent Application No. 2017-175720 filed on Sep. 13, 2017. The entire disclosure of Japanese Patent Application No. 2017-175720 is incorporated herein by reference.

What is claimed is:

1. A method for controlling a valve device, the valve device including:

an inlet through which a liquid flows into the valve device, an outlet through which the liquid flows out of the valve device, and a valve element that opens and closes an inside of the valve device, a flexible film for moving the valve element, and a detector that detects a flow amount of a liquid flow, wherein the method includes;

a first control of opening the valve element by deforming the flexible film in accordance with a negative pressure on the outlet side of the valve element to generate the liquid flow from the inlet to the outlet through the inside of the valve device;

a second control of opening the valve element by deforming the flexible film by an external force to generate the liquid flow from the inlet to the outlet through the inside of the valve device; and performing the first control in a case where the detector detects a first flow amount, and performing the second control in a case where the detector detects a second flow amount which is lower than the first flow amount.

2. The method according to claim 1, wherein the first control includes a first mode in which a pressure in the inflow channel is set to a positive pressure, a second mode in which a pressure in the outflow channel is set to a negative pressure, and a third mode in which the pressure in the inflow channel is set to a positive pressure and the pressure in the outflow channel is set to a negative pressure, and wherein the liquid flow is generated by selectively switching the first mode, the second mode, and the third mode.

3. The method according to claim 2, wherein a first liquid flow is generated in the first mode, a second liquid flow is generated in the second mode, and a third liquid flow is generated in the third mode, wherein the first, second, and third liquid flows are different flow amounts from one another.

4. The method according to claim 1, wherein the second control is performed on a basis of a pressure detected in the outflow channel.

5. The method according to claim 1, wherein the second control is performed on a basis of a flow amount of the liquid detected in the inflow channel or the outflow channel.

6. The method according to claim 1, wherein the liquid ejecting apparatus includes a cap that comes into contact with the liquid ejecting head to seal the nozzle, and the liquid flow is generated by the first control and the second control in a state in which the liquid ejecting head and the cap are separated from each other.

7. The method according to claim 1, wherein the liquid ejecting apparatus includes a flexible film for moving the valve, wherein the flexible film has a first surface that constitutes part of the inflow channel downstream of the valve and a second surface opposite to the first surface, and wherein the valve is opened by deformation of the flexible film according to pressure difference between a pressure on the first surface and a pressure on the second surface.

8. The method according to claim 7, wherein the external force in the second control is a pressure of a pump that deforms the flexible film to open the valve regardless of the pressure difference.

9. A liquid ejecting apparatus comprising:

a liquid ejecting head that has an inner space through which a liquid flows and that is configured to eject the liquid in the inner space through a nozzle;

an inflow channel for flowing the liquid into the inner space;

an outflow channel for flowing the liquid out of the inner space;

a valve that is configured to open and close the inflow channel;

a detector that detects a flow amount of a liquid flow; and a controller that controls opening the valve, wherein the controller performs a first control in a case where the detector detects a first flow amount, the first control being control of opening the inflow channel by opening the valve in accordance with a negative pressure on a downstream side of the valve to generate a liquid flow from the inflow channel to the outflow channel through the inner space, and wherein the controller performs a second control in a case where the detector detects a second flow amount which is lower than the first flow amount, the second control being control of opening the inflow channel by opening the valve by an external force to generate the liquid flow from the inflow channel to the outflow channel through the inner space.

10. The liquid ejecting apparatus according to claim 9, wherein the first control includes a first mode in which a pressure in the inflow channel upstream of the valve is set to a positive pressure, a second mode in which a pressure in the outflow channel is set to a negative pressure, and a third mode in which the pressure in the inflow channel upstream of the valve is set to a positive pressure and the pressure in the outflow channel is set to a negative pressure, and wherein the liquid flow is generated by selectively switching the first mode, the second mode, and the third mode.

11. The liquid ejecting apparatus according to claim 10, wherein a first liquid flow is generated in the first mode, a second liquid flow is generated in the second mode, and a third liquid flow is generated in the third mode, wherein the first, second, and third liquid flows are wherein the first, second, and third liquid flows are generated in different flow amounts from one another.

12. The liquid ejecting apparatus according to claim 9, wherein the second control is performed on a basis of a pressure detected in the outflow channel.

13. The liquid ejecting apparatus according to claim 9, wherein the second control is performed on a basis of a flow amount of the liquid detected in the inflow channel or the outflow channel.

14. The liquid ejecting apparatus according to claim 9, wherein the liquid ejecting apparatus includes a cap that comes into contact with the liquid ejecting head to seal the nozzle, and the liquid flow is generated by the first control and the second control in a state in which the liquid ejecting head and the cap are separated from each other.

15. The liquid ejecting apparatus according to claim 9, wherein the liquid ejecting apparatus includes a flexible film for moving the valve, wherein the flexible film has a first surface that constitutes part of the inflow channel downstream of the valve and a second surface opposite to the first surface, and wherein the valve is opened by deformation of the flexible film according to pressure difference between a pressure on the first surface and a pressure on the second surface.

16. The liquid ejecting apparatus according to claim 15, wherein the external force in the second control is a pressure of a pump that deforms the flexible film to open the valve regardless of the pressure difference.

17. The liquid ejecting apparatus according to claim 9, wherein the controller performs the first control and does not perform the second control, in a case where the detector detects the first flow amount.

18. The liquid ejecting apparatus according to claim 9, wherein the controller performs both of the first control and the second control, in a case where the detector detects the second flow amount.

19. A liquid ejecting apparatus comprising:

a liquid ejecting head that includes an inner space through which a liquid flows and that is configured to eject the liquid in the inner space through a nozzle;

an inflow channel for flowing the liquid into the inner space;

an outflow channel for flowing the liquid out of the inner space; and a valve that is configured to open and close the inflow channel, wherein the liquid ejecting apparatus performs a first control of opening the inflow channel by opening the valve in accordance with a negative pressure on a downstream side of the valve to generate a liquid flow from the inflow channel to the outflow channel through the inner space and a second control of opening the inflow channel by opening the valve by an external force to generate the liquid flow from the inflow channel to the outflow channel through the inner space, and wherein the liquid ejecting apparatus performs the second control, in accordance with a flow amount of the liquid flow, to open the valve under the first control, and wherein the second control is performed on a basis of a flow amount of the liquid detected in the inflow channel or the outflow channel.

20. A liquid ejecting apparatus comprising:

a liquid ejecting head that has an inner space through which a liquid flows and that is configured to eject the liquid in the inner space through a nozzle;

an inflow channel for flowing the liquid into the inner space;

an outflow channel for flowing the liquid out of the inner space; and a valve that is configured to open and close the inflow channel, wherein the liquid ejecting apparatus performs a first control of opening the inflow channel by opening the valve in accordance with a negative pressure on a downstream side of the valve to generate a liquid flow from the inflow channel to the outflow channel through the inner space and a second control of opening the inflow channel by opening the valve by an external force to generate the liquid flow from the inflow channel to the outflow channel through the inner space, and wherein the liquid ejecting apparatus performs the second control, in accordance with a flow amount of the liquid flow, to open the valve under the first control, and wherein the liquid ejecting apparatus includes a flexible film for moving the valve, wherein the flexible film has a first surface that constitutes part of the inflow channel downstream of the valve and a second surface opposite to the first surface, and wherein the valve is opened by deformation of the flexible film according to a pressure difference between a pressure on the first surface and a pressure on the second surface, and wherein the external force in the second control is a pressure of a pump that deforms the flexible film to open the valve regardless of the pressure difference.

* * * * *